United States Patent [19]

Beck et al.

[11] Patent Number: 4,972,858

[45] Date of Patent: Nov. 27, 1990

[54] DUAL COSMETIC APPLICATOR AND CONTAINER

[75] Inventors: Marlene Beck, New York, N.Y.; Martin M. Vasas, Fairfield, Conn.

[73] Assignee: Elizabeth Arden Co., division of Conopco, Inc., New York, N.Y.

[21] Appl. No.: 260,950

[22] Filed: Oct. 21, 1988

[51] Int. Cl.[5] ..... A45D 40/26

[52] U.S. Cl. ..... 132/218; 132/320; 401/18; 401/126; 401/129

[58] Field of Search ..... 132/216, 218, 310, 314, 132/320; 401/17, 18, 35, 36, 122, 126, 129; 15/184, 206, 207

[56] References Cited

U.S. PATENT DOCUMENTS

| | | | |
|---|---|---|---|
| 1,029,077 | 6/1912 | Metzger | 401/18 |
| 1,905,399 | 4/1933 | Wagner | 15/160 |
| 2,131,539 | 9/1938 | Mureau | 132/317 |
| 2,576,550 | 11/1951 | Waters | 132/308 |
| 3,033,213 | 5/1962 | Joss et al. | 132/218 |
| 3,921,650 | 11/1975 | Montgomery | 132/218 |
| 3,925,843 | 12/1975 | Tsuruzawa et al. | 15/184 |
| 4,390,298 | 6/1983 | Caluccio | 401/122 |
| 4,458,701 | 7/1984 | Holland | 132/218 |
| 4,600,328 | 7/1986 | Clements | 401/18 |
| 4,886,080 | 12/1989 | Cole et al. | 132/320 |

FOREIGN PATENT DOCUMENTS

| | | | |
|---|---|---|---|
| 0236133 | 3/1987 | European Pat. Off. | 132/218 |
| 820792 | 11/1951 | Fed. Rep. of Germany . | |
| 2037409 | 7/1970 | Fed. Rep. of Germany | 401/17 |
| 3240152 | 5/1984 | Fed. Rep. of Germany . | |
| 3610007 | 3/1986 | Fed. Rep. of Germany | 401/129 |
| 1310355 | 11/1962 | France | 132/216 |
| 1315639 | 5/1973 | United Kingdom | 401/17 |
| 2064314 | 6/1981 | United Kingdom . | |

*Primary Examiner*—John J. Wilson
*Assistant Examiner*—Frank A. LaViola, Jr.
*Attorney, Agent, or Firm*—Kenyon & Kenyon

[57] ABSTRACT

The invention provides a dual cosmetic applicator and container for applying cosmetic, especially mascara, to the eyelashes in which a pair of eyelash brushes engage each other on the inside of a container holding a quantity of cosmetic. When an eyelash brush is removed from the container its bristles rub against the bristles of the other brush so as to mix the cosmetic which is applied to the brush. This mixing action tends to thin thixotropic cosmetic like mascara, making application of mascara to the eyelashes easier.

19 Claims, 1 Drawing Sheet

10
12
14
16
18
20
22
24
26
28
30
32
34
36
38

DUAL COSMETIC APPLICATOR AND CONTAINER

BACKGROUND OF THE INVENTION

This invention relates to the application of cosmetics, and more particularly to a device for applying cosmetics, such as mascara, to the eyelashes. The invention further relates to a device which acts as a container for storing cosmetics, especially mascara, when the device is not being used as an applicator. The invention further relates to a device which thins mascara just prior to the application of the mascara to the eyelashes.

The prior art discloses cosmetic applicators and containers for mascara. The typical mascara applicator is a slender rod which is equipped with a brush or a set of bristles at the end for contact with the eyelashes. The brush is inserted into a cylindrical container of the mascara, removed from the container and then contacted with the eyelashes for application.

One of the problems encountered when applying mascara in this manner is difficulty in applying the mascara to the brush and the eyelashes evenly. This difficulty is due to the tendency of the mascara to thicken in the container over periods of time. Excessively thick mascara tends to accumulate on and stick to the applicator brush, making it difficult to apply evenly.

The prior art discloses wipers for removing excess mascara from applicator brushes. For example, U.S. Pat. No. 4,390,298 discloses a wiper plug, defined by a rim or edge of the cosmetic container, for removing excess liquid from the applicator brush when the applicator is removed from the cosmetic container. U.S. Pat. No. 3,033,213 discloses a resilient wiping member for wiping excess mascara off of a mascara brush. U.S. Pat. No. 2,131,539 discloses a serrated edge for evenly distributing mascara on an applicator brush. These prior art devices have been somewhat effective in removing excess mascara from an applicator brush prior to application. However, these devices fail to solve the problem of uneven mascara distribution on the mascara brush caused by mascara which has become thickened over periods of non-use.

Mascara users have attempted to solve the problem of thickened mascara by rapidly moving the applicator brush back and forth within the container in an effort to mix the mascara and, hopefully, thin it. However, this procedure is not completely effective in applying mascara to the brush uniformly and is often an unavoidably sloppy process.

SUMMARY OF THE INVENTION

The invention provides a dual cosmetic applicator and container for applying cosmetics, especially mascara, to the eyelashes. A cosmetic container is provided with two open ends, each end capable of receiving a cosmetic applicator. Each cosmetic applicator is a rod which is provided with a brush or a set of bristles at the end thereof which is designed to be inserted into an open end of the cosmetic container. One applicator may be designed for applying cosmetic to the lower lashes, and the other may be designed for the upper lashes. The opposite end of each cosmetic applicator is equipped with a handle or cap which is designed to close the open end of the container, preferably in a screw-on cap type fashion, when the cosmetic applicator is completely inserted into the container. The distance between the open ends of the container and the length of the rods of the cosmetic applicators are such that when each cosmetic applicator is completely inserted into the container the bristles of each applicator engage each other inside of the container.

When it is desired to apply the cosmetic, such as mascara, inside of the container to the eyelashes, one applicator is removed from the container, preferably by rotating its handle. As the applicator is removed, the mascara located between the brushes is mixed by the action of the bristles rubbing against each other. Since mascara is thixotropic, this mixing action thins or liquifies the mascara applied to the brush so that mascara is applied to the brush, and subsequently the eyelashes, evenly. In addition, the rubbing of the bristles of the two brushes against one another acts to clean the bristles and remove, for example, dried particles of mascara. Preferably, the container is equipped with wiper means at each of its ends for removing excess mascara from the brushes as the applicators are removed from the container.

Accordingly, it is an object of the invention to provide a mascara applicator and container which is capable of mixing and thinning the mascara to be applied to the eyelashes just prior to application.

It is a further object of the invention to provide a cosmetic applicator and container in which the brushes of each applicator engage each other inside of the container.

It is a further object of the invention to provide a cosmetic container containing two cosmetic applicators, each of which is capable of applying cosmetic to the eyelashes.

Additional objects and advantages of the invention may be appreciated upon reading the following specification wherein the preferred embodiment of the invention is described in detail.

BRIEF DESCRIPTION OF THE DRAWINGS

Referring to the accompanying drawings, which are for illustrative purposes.

DESCRIPTION OF THE PREFERRED EMBODIMENT

Figures 1, 2, 3, 4:
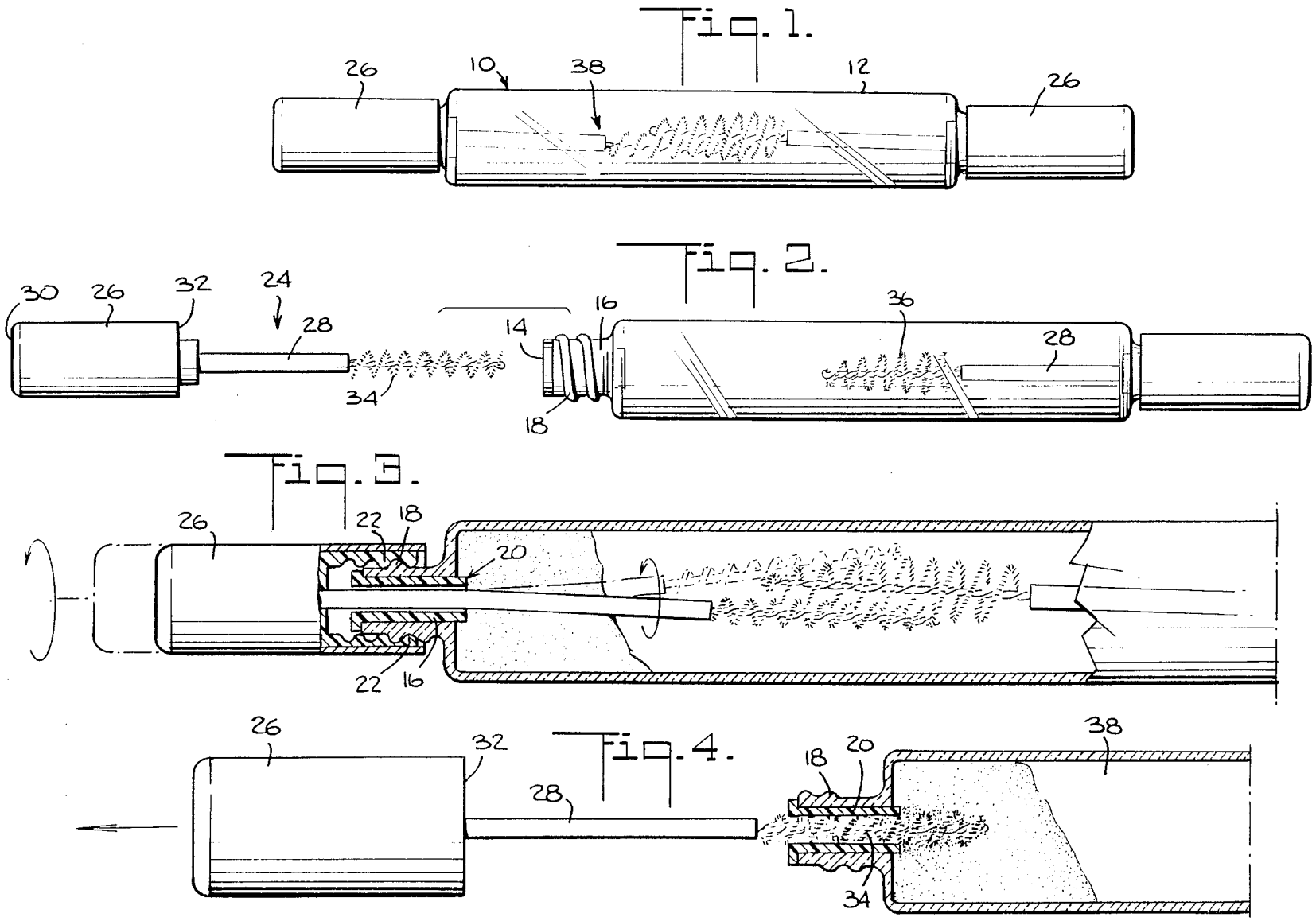
FIG. 1 is a planar view of the dual cosmetic applicator and container of the invention where each cosmetic applicator is completely inserted into the container so as to close it, depicting the engagement of the applicator brushes inside the container.
FIG. 2 is a planar view of the dual cosmetic applicator and container depicting an applicator which has been removed from the container.
FIG. 3 is a detailed view of the container as shown in FIG. 1.
FIG. 4 is another detailed view of the container showing the action of a wiping member on an applicator brush.

Referring to FIG. 1, the dual cosmetic applicator and container of the invention is generally depicted at 10. A hollow container 12 for storing a quantity of cosmetic 38, such as mascara, is provided. The container is preferably cylindrical in shape as depicted. The container may be constructed of a sturdy transparent material such as plastic so that the quantity of cosmetic remaining in the container can be seen.

Each end of the container is provided with an opening 14 for receiving a cosmetic applicator 24 (generally depicted in FIG. 2). As depicted, each cosmetic applicator extends axially into the container 12 through openings 14. The segment of the container 12, near the vicinity of each of the openings 14, is defined by a neck 16 which is provided with external threads 18 on the external surface thereof, whose function shall be explained hereinafter.

Referring to FIGS. 3 and 4, it can be seen that the interior surface of container 12 is provided with a wiper member 20 in each neck 16. Each wiper member 20 is sealed to the inner surface of neck 16 and extends axially from opening 14 into container 12. Each wiper member 20 defines a bore which is of a reduced diameter as compared to the diameter of the container 12 so as to define a wiping surface for the cosmetic applicators as explained hereinafter.

Referring to FIG. 2, a cosmetic applicator is generally depicted at 24. The invention provides at least a pair of cosmetic applicators. Each applicator is defined by a handle or cap 26 which is connected to a slender rod or wand 28. Each handle 26 is a hollow tube having a closed end 30 and an open end 32 which receives rod 28. Rod 28 extends axially into handle 26 through its open end 32 and is attached to the closed end 30 of handle 26. The open end 32 is also designed to receive a neck 16 of the container 12. Referring to FIG. 3, the inner surface of handle 26 is provided with internal threads 22 which are designed to engage with the external threads 18 of neck 16 so that handle 26 may be rotatably fastened to container 12 in a screw on type fashion. It can be seen that before handle 26 is screwed onto neck 16, rod 28 must be inserted into container 12 through opening 14.

An eyelash brush 34 or 36 is fixedly wrapped around a segment of each rod 28 near the free end of each cosmetic applicator 24. Each brush 34 or 36 is comprised of a plurality of bristles which stand on end to extend away from the surface of rod 28 and which are designed to apply mascara to the eyelashes. As appreciated by those skilled in the art, eyelash brush bristles should be both resilient and flexible. Referring to FIG. 4, the circumference of each brush 34, 36 should be slightly larger than that of the bore defined by wiping member 20 so that the brush bristles make contact with and are bent by wiping member 20 when passed therethrough. In this manner, excess mascara is removed from the brush when the cosmetic applicator is removed from the container.

Preferably, the brushes 34 and 36 are of two different designs so that the user has an option of which brush to use. For example, one of the brushes may be designed for use with the lower eyelashes and the other brush for the upper eyelashes. Preferably one brush 34 is comprised of a series of bristles which are all approximately the same size and which are grouped so as to define a series of circumferentially extending grooves on a segment of rod 28 at its free end. The groups of bristles may be arranged so as to define a series of closely spaced annular grooves, or, as depicted in FIG. 2, the bristles may be arranged so as to form a helical thread (defining a helical groove) on rod 28. The second brush 36 is preferably constructed the same way except that the groups of bristles may be spaced closer together than the groups of bristles on the other brush so that only very thin grooves or no grooves are defined. Furthermore, the length of the bristles of the second brush should vary so that the circumference of the brush increases from the free end of rod 28 in the direction towards handle 26 until the approximate axial midway point of the brush (see FIG. 2, brush 36). The length of the bristles from the axial midway point to the end of the brush which is closest to handle 26 should each be approximately the same size and longer than the bristles of the other brush 34 as shown in FIG. 2.

Referring to FIGS. 1 and 3, the dual cosmetic applicator and container is depicted with both cosmetic applicators 24 fastened on the container so as to close its opened ends 14. As can be seen, the length of the rods 28 of each applicator 24 are such that the brushes of each applicator 34, 36 engage each other inside the container 12 when the handles 26 of each applicator are fastened onto the necks 16 of container 12. The brushes of each applicator should interface along a substantial portion of their longitudinal axial length, and preferably along their entire length as depicted in FIGS. 1 and 3.

To apply mascara to the eyelashes, the handle 26 of one of the applicators is unfastened from container 12. As the handle 26 is turned, its brush 34 or 36 rotates around the brush of the other applicator. This rotation causes the bristles to rub against each other and the mascara between the brushes is mixed by this action. Mascara is thixotropic and this mixing action caused by the rotation and turbulence of the brushes has been found to liquify or thin the mascara which adheres to the brushes so that the mascara can be applied to the eyelashes evenly. In addition, rotation of the brushes against one another acts to clean the brushes and remove, for example, dried particles of mascara. Excess mascara on brush 34 or 36 is wiped off when the applicator is removed from container 12 as the brush passes through the bore of wiping member 20 (see FIG. 4). The brush of the applicator is then stroked along the eyelashes to apply the mascara. Because the mascara which has been picked up by the brush has been thinned, it is easy to apply evenly to the lashes. When more mascara is needed, the brush is reinserted into the container and handle 26 is fastened back onto the neck of the container. The application process is then repeated. It should be noted that in the case of mascara which has been thickened during extended periods of non-use it may be desirable to rotate the brushes in the container several times before applying the mascara in order to thin it to a greater extent.

What is claimed is:

1. A cosmetic applicator and container for use in the application of cosmetics, especially mascara, to eyelashes comprising:

a container for holding a quantity of cosmetic therein, having at least two openings, each opening for allowing access of an eyelash brush inside of the container, and at least two cosmetic applicators, each cosmetic applicator comprising an eyelash brush and a means coupled to the brush for capping one of the respective openings, said eyelash brushes being removably inserted in the respective openings of said container and capped thereon, said eyelash brushes engaging each other inside the container and one of said brushes rubbing against another of said brushes upon removal from the container causing the cosmetic to mix in the vicinity of said brushes.

2. A cosmetic applicator and container according to claim 1 wherein the container is cylindrical and has two cosmetic applicators.

3. A cosmetic applicator and container according to claim 2 wherein the eyelash brush of one cosmetic applicator interfaces along substantially its entire longitudinal axial length with the eyelash brush of the other cosmetic applicator when the cap means of both cosmetic applicators are fastened onto the container.

4. A cosmetic applicator and container according to claim 3 wherein the container is provided with a wiping member on its inner surface near the vicinity of at least one opening.

5. A cosmetic applicator and container according to claim 4 wherein said wiping member is a cylindrical insert whose outer surface is fixedly attached to the inner surface of said container so as to define a bore of a diameter which is smaller than the diameter of the eyelash brush of at least one cosmetic applicator, whereby when said eyelash brush is passed through said wiping member said eyelash brush engages said wiping member to remove excess mascara therefrom.

6. A cosmetic applicator and container according to claim 2 wherein the openings of the container are at opposite ends of the cylindrical container and wherein the eyelash brushes of each of the cosmetic applicators are positioned along substantially the same longitudinal axis when the cap means of both cosmetic applicators are capped onto the container.

7. A cosmetic applicator and container according to claim 6 wherein at least one eyelash brush is comprised of a plurality of resiliently flexible bristles which are arranged so as to define a plurality of closely spaced annular grooves.

8. A cosmetic applicator and container according to claim 1 which contains a quantity of mascara.

9. A cosmetic applicator and container according to claim 1 wherein said cap means are rotatably fastenable onto the container, whereby when a cap means is unfastened from the container by rotation its corresponding eyelash brush rubs against the eyelash brush of another cosmetic applicator to mix cosmetic between said eyelash brushes.

10. A mascara applicator and container for use in the application of mascara to eyelashes, comprising:

a container for holding a quantity of mascara therein, having at least two necks, each of said necks defining a bore for allowing access of an applicator wand inside of the container, each of said necks having a plurality of threads around the periphery thereof for allowing rotational coupling of each said necks with a cap means; and at least two mascara applicators, each mascara applicator including an applicator wand, an eyelash brush, fixedly wrapped around the periphery of said wand at a free end segment thereof, and a cap means having a bore therein which terminates at a closed end of said cap means, said wand being attached to the closed end of the cap means at a non-free end of the wand, said cap means having a plurality of threads on the surface of its bore which are releasably engaged with the threads on a neck of the container, said applicator wands being removably inserted in the respective bores of said container and capped thereon, said eyelash brushes of at least two mascara applicators engaging each other inside of the container and one of said brushes rubbing against another of said brushes upon removal from the container causing the mascara to mix in the vicinity of said brushes.

11. A mascara applicator and container according to claim 10 wherein the container is cylindrical and has two necks and two mascara applicators.

12. A mascara applicator and container according to claim 11 wherein the eyelash brush of one mascara applicator interfaces along substantially its entire longitudinal axial length with the eyelash brush of a second mascara applicator when the cap means of both mascara applicators are fastened onto the container.

13. A mascara applicator and container according to claim 12 wherein the necks are at opposite ends of the cylindrical container and wherein the eyelash brushes of each of the mascara applicators are positioned along substantially the same longitudinal axis when the cap means of both mascara applicators are fastened onto the container.

14. A mascara applicator and container according to claim 13 wherein at least one eyelash brush is comprised of a plurality of resiliently flexible bristles which are arranged so as to define a plurality of closely spaced annular grooves.

15. A mascara applicator and container according to claim 12 wherein at least one of said necks is provided with a wiping member on its inner surface.

16. A mascara applicator and container according to claim 15 wherein said wiping member is a cylindrical insert with an outer surface which is fixedly attached to an inner surface of said necks so as to reduce the diameter of the bore defined by said neck, and wherein the diameter of the bore defined by the neck containing said wiping member is smaller than the diameter of the eyelash brush of at least one mascara applicator, whereby when said eyelash brush is passed through said wiping member said eyelash brush engages an inner surface of said wiping member.

17. A cosmetic applicator and container for use in the application of cosmetics, especially mascara, to eyelashes, comprising:

a cylindrical container for holding a quantity of cosmetic therein having an opening at each of two opposite ends of the container for allowing access of an eyelash brush inside of the container; and a pair of cosmetic applicators, each applicator including an eyelash brush coupled to a means for capping an opening of the container, said eyelash brushes being removably inserted into respective openings of said container and capped thereon, said eyelash brushes of both cosmetic applicators being positioned along substantially the same longitudinal axis and engaging each other inside the container.

18. A cosmetic applicator and container according to claim 17 wherein the eyelash brush of one cosmetic applicator interfaces along substantially its entire longitudinal axial length with the eyelash brush of the other applicator when the cap means of both cosmetic applicators are fastened onto the container.

19. A cosmetic applicator and container according to claim 17 wherein the container is provided with at least one cylindrical insert near a container opening having an outer surface which is fixedly attached to the inner surface of the container so as to define a bore having a diameter which is less wide than the diameter of the eyelash brush of a cosmetic applicator, whereby when said eyelash brush is passed through said cylindrical insert said eyelash brush engages an inner surface of said insert to remove excess cosmetic therefrom.

* * * * *